US009055823B1

(12) United States Patent
Jannetides et al.

(10) Patent No.: US 9,055,823 B1
(45) Date of Patent: Jun. 16, 2015

(54) LIFT BED WITH UNIFIED LOCKING MECHANISM AND MULTIFUNCTION BRACKET

(75) Inventors: James N. Jannetides, Fishers, IN (US); Adam Anderson, Indianapolis, IN (US)

(73) Assignee: J Squared, Inc., Greenfield, IN (US)

( * ) Notice: Subject to any disclaimer, the term of this patent is extended or adjusted under 35 U.S.C. 154(b) by 0 days.

(21) Appl. No.: 13/532,569

(22) Filed: Jun. 25, 2012

Related U.S. Application Data

(60) Provisional application No. 61/500,895, filed on Jun. 24, 2011.

(51) Int. Cl.

| | |
|---|---|
| ***A47B 83/00*** | (2006.01) |
| ***A47C 19/22*** | (2006.01) |
| ***A47C 19/02*** | (2006.01) |

(52) U.S. Cl.
CPC ..... *A47C 19/22* (2013.01); *A47C 19/021* (2013.01)

(58) Field of Classification Search
CPC ..... A47C 19/22; A47C 19/20; A47C 17/86; A47C 17/52; A47C 13/00
USPC ..... 5/2.1, 58, 412, 503.1; 70/82, 85, 86; 109/53, 56, 57, 59 R, 59 T; 312/216, 312/218, 319.2, 319.8, 327
See application file for complete search history.

(56) References Cited

U.S. PATENT DOCUMENTS

| | | | | |
|---|---|---|---|---|
| 1,077,199 | A * | 10/1913 | James | 4/547 |
| D49,273 | S | 2/1916 | Murphy | |
| 4,742,900 | A * | 5/1988 | Boxhammer | 190/2 |
| 5,070,556 | A | 12/1991 | Gloger | |
| 5,687,435 | A * | 11/1997 | Dufresne | 5/10.1 |
| 5,713,650 | A * | 2/1998 | King et al. | 312/265.4 |
| 6,292,960 | B1 * | 9/2001 | Bowling | 5/308 |
| 6,572,174 | B2 * | 6/2003 | Hernandez et al. | 296/100.09 |
| 6,611,973 | B2 | 9/2003 | Connell | |
| 7,367,069 | B2 * | 5/2008 | Connell et al. | 5/136 |
| 7,917,977 | B1 * | 4/2011 | Remis | 5/308 |
| 2003/0057725 | A1 * | 3/2003 | Hernandez et al. | 296/100.09 |
| 2007/0256240 | A1 * | 11/2007 | Regev et al. | 5/412 |
| 2010/0314978 | A1 * | 12/2010 | Manalang et al. | 312/243 |

* cited by examiner

*Primary Examiner* — Timothy D Collins
*Assistant Examiner* — Richard G Davis
(74) *Attorney, Agent, or Firm* — William F. Bahret

(57) ABSTRACT

A lift bed having a bed frame with a mattress-supporting platform pivotally mounted on a side wall of the frame so as to function as the lid for a storage compartment within the frame, which also includes pull-out side drawers alongside the storage compartment, and a unified locking mechanism capable of simultaneously locking the drawers and storage compartment. A bellcrank drives a locking member for the storage compartment and a locking member for the drawers, the latter locking member extending freely from the bellcrank to a wall separating the storage compartment from the side drawers. The bed frame includes multifunction corner brackets each of which interconnects perpendicular walls of the frame, hingedly supports the platform, and secures one end of a gas spring which assists in lifting the platform.

5 Claims, 13 Drawing Sheets

LIFT BED WITH UNIFIED LOCKING MECHANISM AND MULTIFUNCTION BRACKET

CROSS-REFERENCE TO RELATED APPLICATION

This application claims the benefit of Provisional Patent Application No. 61/500,895, filed Jun. 24, 2011 and hereby incorporated by reference.

BACKGROUND OF THE INVENTION

The present invention relates to beds of the type sometimes referred to as storage platform beds, i.e., platform beds having a storage area under the mattress support surface or platform, and more particularly to such beds having a pivotally mounted platform, referred to herein as lift beds.

Attempts to economize on the use of floor space in bedrooms and other quarters are legion, dating back centuries and including such famous examples as the Murphy bed, or wall bed or pull-down bed, from the early 1900s. Floor space is particularly at a premium in living quarters such as dormitory rooms, military barracks, and small apartments. It is known not only to move beds when not in use, such as with Murphy beds, but to otherwise use the same floor space for multiple purposes. For example, a loft bed leaves floor space underneath it for other furniture such as a chair, desk or dresser. It is also known to use the available floor space under a conventional bed frame for storage of clothing and other items, often with a bed skirt hanging from the bed frame to obscure the view of such items. While many conventional bed frames incidentally have such free space underneath them, there are other bed frames with facilities specifically designed for storage. For example, U.S. Pat. No. 5,070,556 to Gloger discloses a bed frame with legs and multiple roller-supported drawers which are slidably mounted to horizontal beams incorporated into the bed frame. The drawers occupy the otherwise empty area between the floor and the box spring.

Also, platform beds, which include a hard horizontal platform for supporting a mattress without a box spring, are available with drawers underneath the platform as storage space. Certain platform beds have a pivotally mounted platform which can be lifted on one side to provide access to a storage area under the mattress support surface. Once lifted, the platform may be held in its raised position by a gas or air spring. An example of such a configuration is disclosed in U.S. Pat. No. 6,611,973 to Connell.

SUMMARY OF THE INVENTION

The present invention provides, as one aspect thereof, a lift bed comprising a bed frame having a mattress platform pivotally mounted on a first side wall thereof, a plurality of storage facilities within the walls of the bed frame, the storage facilities including a main storage compartment and at least one drawer alongside it, and a unified locking mechanism capable of simultaneously locking the storage facilities. The storage compartment is configured to be opened and closed by raising and lowering the pivotally mounted platform, respectively, the storage compartment and drawer being covered by the platform when it is in its lowered position,. The storage compartment has an end wall separating it from the drawer. The unified locking mechanism includes a bellcrank, a locking arm driven by the bellcrank to lock the storage compartment closed, and at least one locking rod driven by the bellcrank to lock the drawer closed, the locking rod extending freely from the bellcrank to the end wall of the storage compartment.

Another aspect of the present invention is a lift bed with a mattress-supporting platform hingedly attached to the top of one side of the bed frame, and with multifunction brackets which each (1) serve to join perpendicular wall panels of the bed frame together, (2) act as a hinge for the platform, and (3) act as a mounting point for a gas spring which assists in lifting the platform and holds it in its raised position.

The objects and advantages of the present invention will be more apparent upon reading the following detailed description in conjunction with the accompanying drawings.

DESCRIPTION OF PREFERRED EMBODIMENTS

Figure 1:
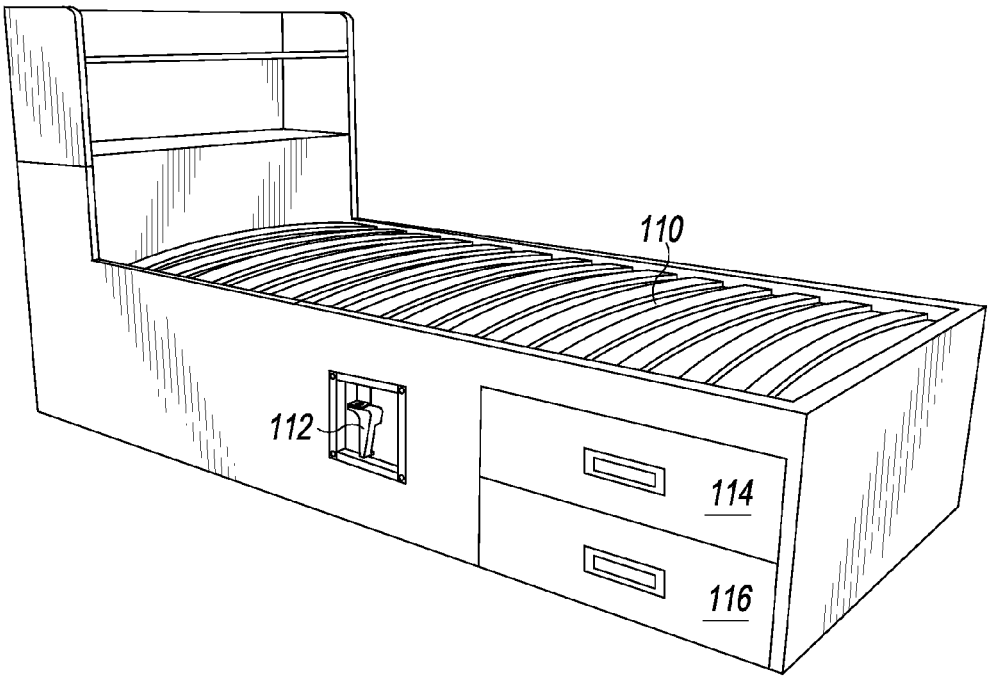
FIG. 1 is a perspective view of one preferred embodiment of a lift bed in accordance with the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

One embodiment of the present invention is a lift bed with a mattress-supporting platform hingedly attached to the top of one side of the bed frame, and with multiple storage facilities in the bed frame and a single locking mechanism for locking them closed. Another embodiment, which may be combined with the first embodiment, includes multifunction brackets which each (1) serve to join perpendicular walls of the bed frame together, (2) act as a hinge for the platform, and (3) act as a mounting point for a gas spring which assists in lifting the platform and holds it in its raised position.

Figure 19:
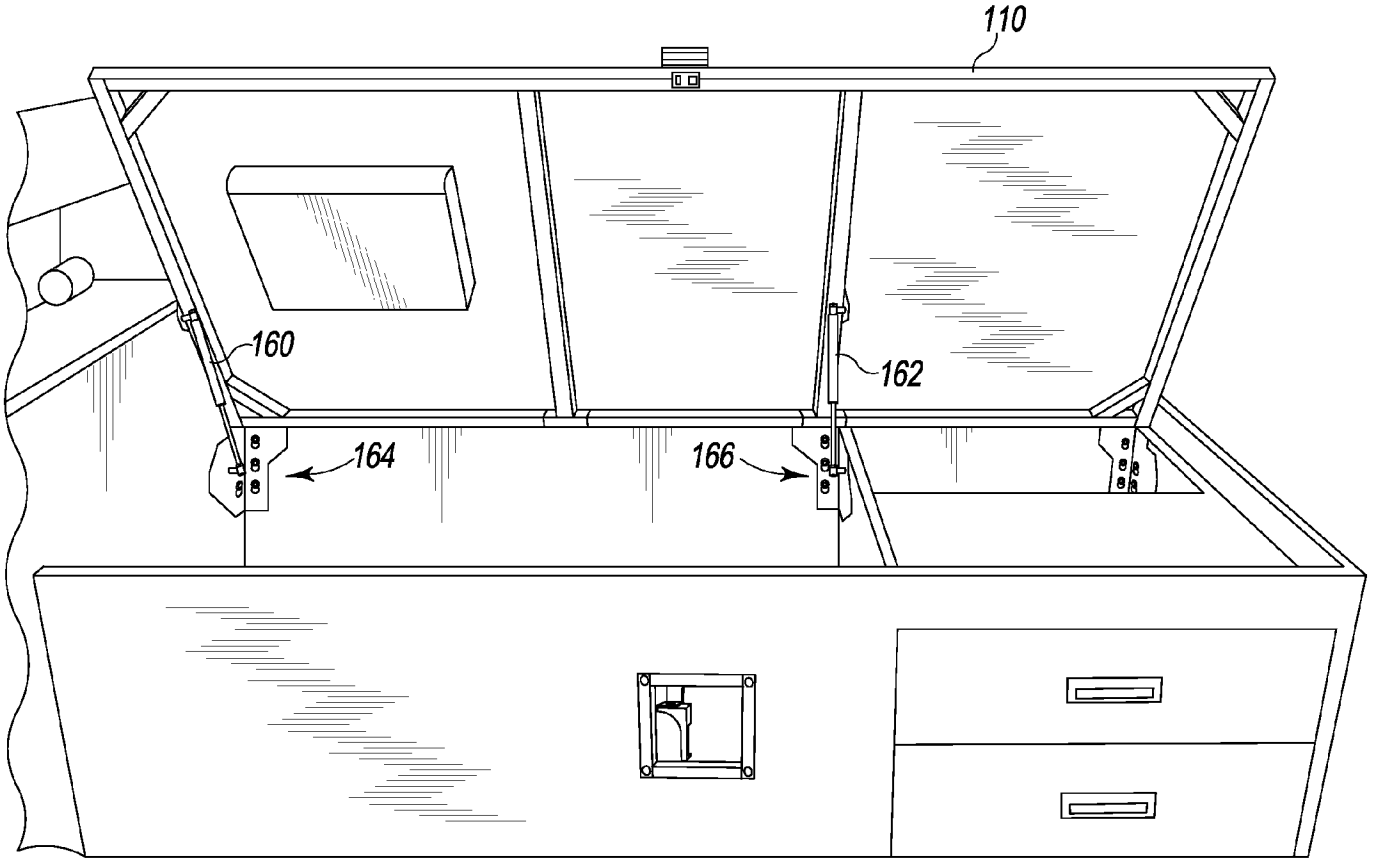
FIG. 19 is a perspective view of another preferred embodiment of a lift bed in accordance with the present invention, the bed having multifunction corner brackets.

FIG. 1 is a perspective view of a lift bed with a bed frame having a platform for supporting a mattress. The platform is hingedly attached to the top of one side of the bed frame. Hereinafter, the platform is sometimes referred to as the "bed lid" and is labeled as item 110 in the figures. The bed lid 110 is in the closed position in FIG. 1. When the bed lid is opened, it provides access to a storage compartment located underneath it and adjacent to a compartment holding drawers 114 and 116, as can be seen in FIG. 19. A locking handle 112 is located to the left of the drawers.

Figure 2:
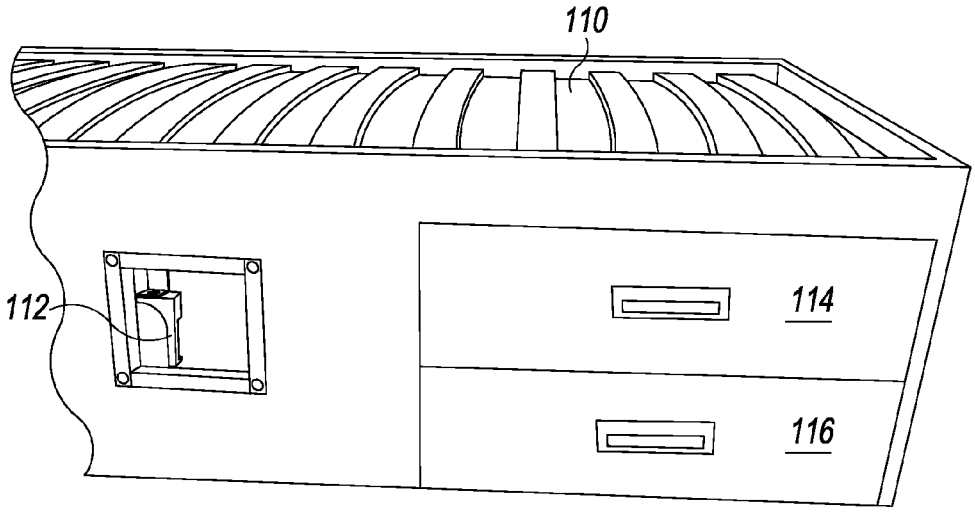
FIG. 2 is another perspective view of the lift bed of FIG. 1.
Figure 3:
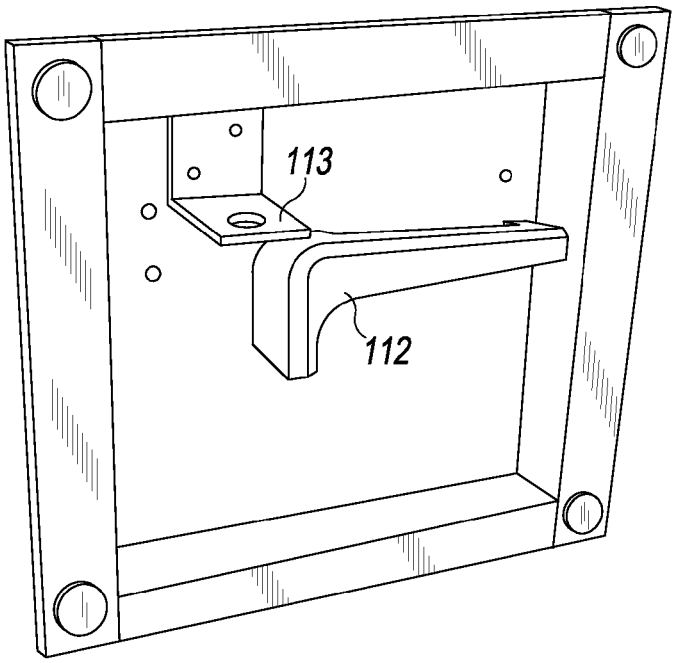
FIGS. 3 and 4 show the locking handle for the lift bed in its unlocked and locked positions, respectively.
Figure 4:
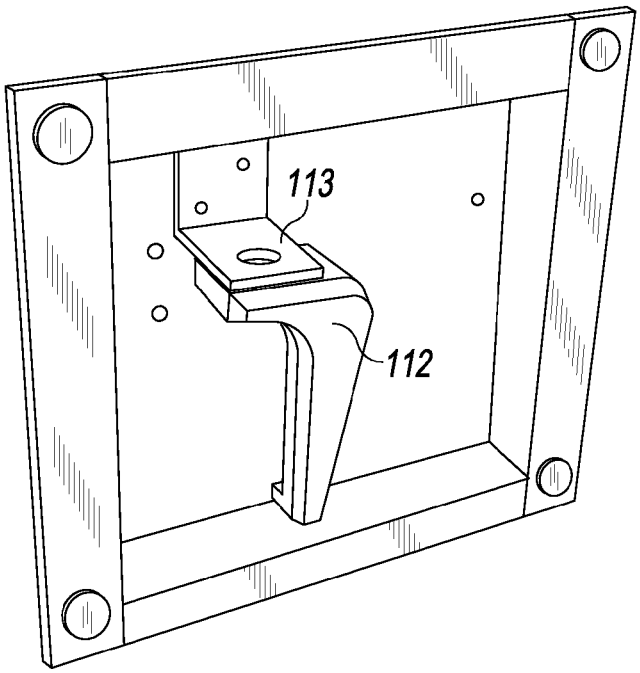

FIG. 2 is another perspective view of the bed, focusing on the locking handle 112 and the two drawers, 114 and 116. Moving to FIGS. 3 and 4, it can be seen that the handle 112 rotates 90 degrees. In FIG. 3, the handle is in the unlocked position. In FIG. 4, the handle has been rotated clockwise by 90 degrees, placing it in the locked position. As can be seen in FIGS. 3 and 4, the handle is pivotally mounted in a recessed metal panel. The handle pivots on an axis which is common to a bellcrank 140 described below. Also mounted in the panel is a tab 113 with a hole therethrough. The top of the locking handle 112 also has a hole through it. When the locking handle 112 is in the locked position, as in FIG. 4, the top of the locking handle 112 is flush with the tab, and the hole in the top of the handle and the hole in tab 113 are aligned so as to allow a padlock or other kind of lock to engage the aligned holes to secure the locking handle in the locked position. Locking handle 112 is used to lock both drawers 114 and 116 and to lock bed lid 110 in the closed position, as explained below.

Figure 5:
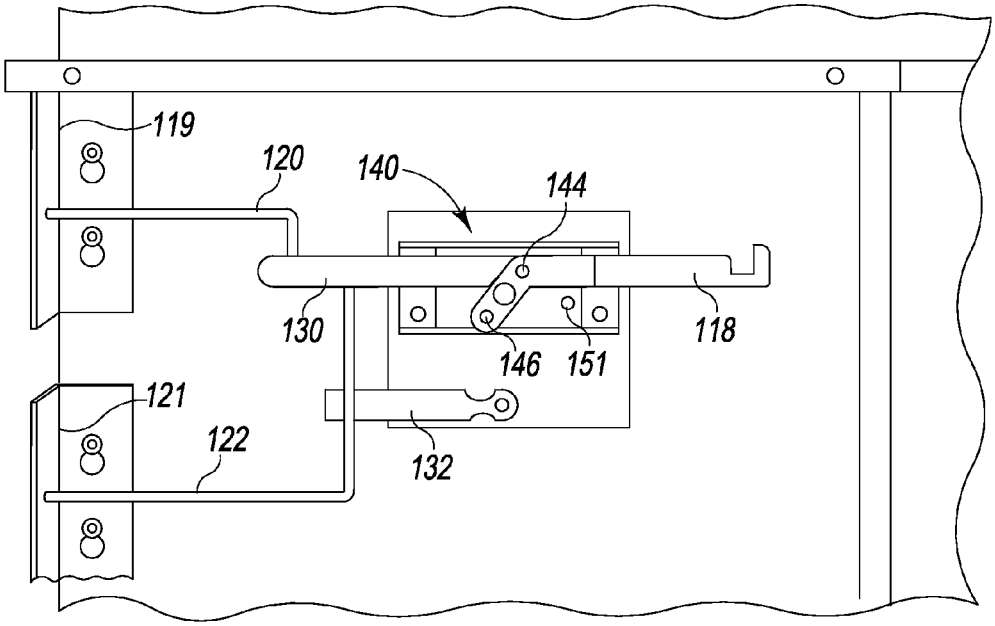
FIGS. 5 and 6 are rear views of the lift bed's locking mechanism from within an internal storage compartment, showing the unlocked and locked positions, respectively.
Figure 6:
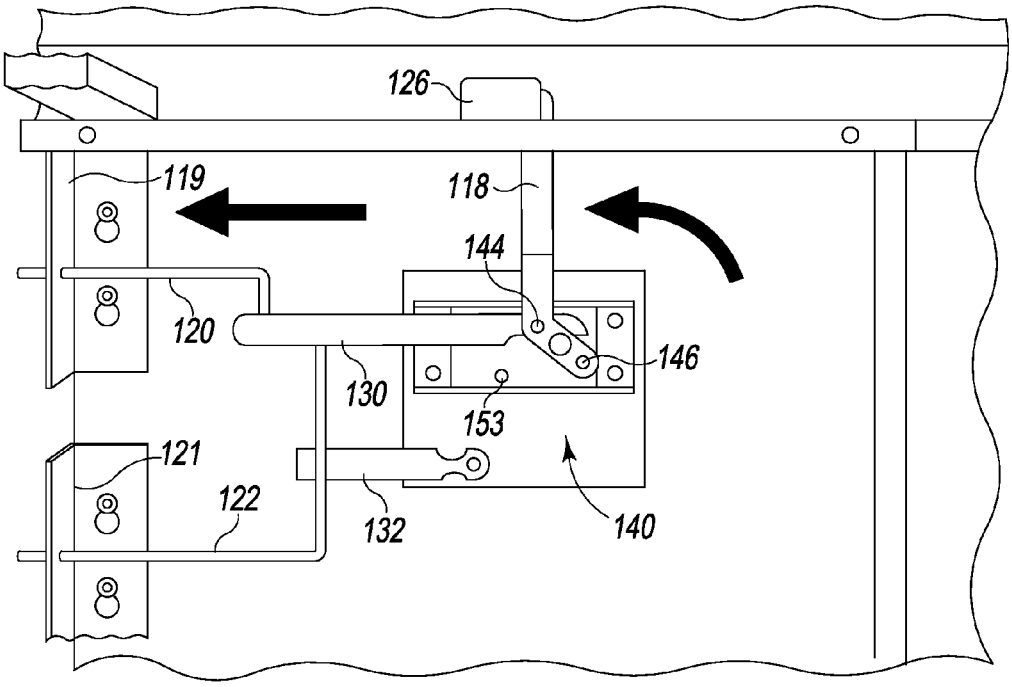
Figure 7:
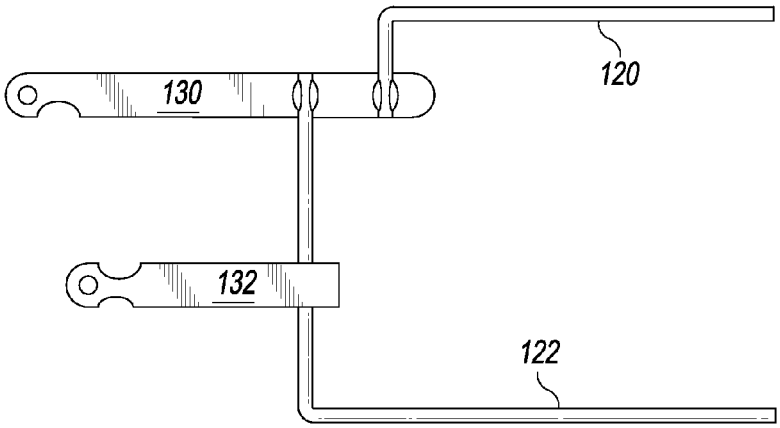
FIG. 7 shows a locking rod assembly from the side opposite that shown in FIGS. 5 and 6.
Figure 8:
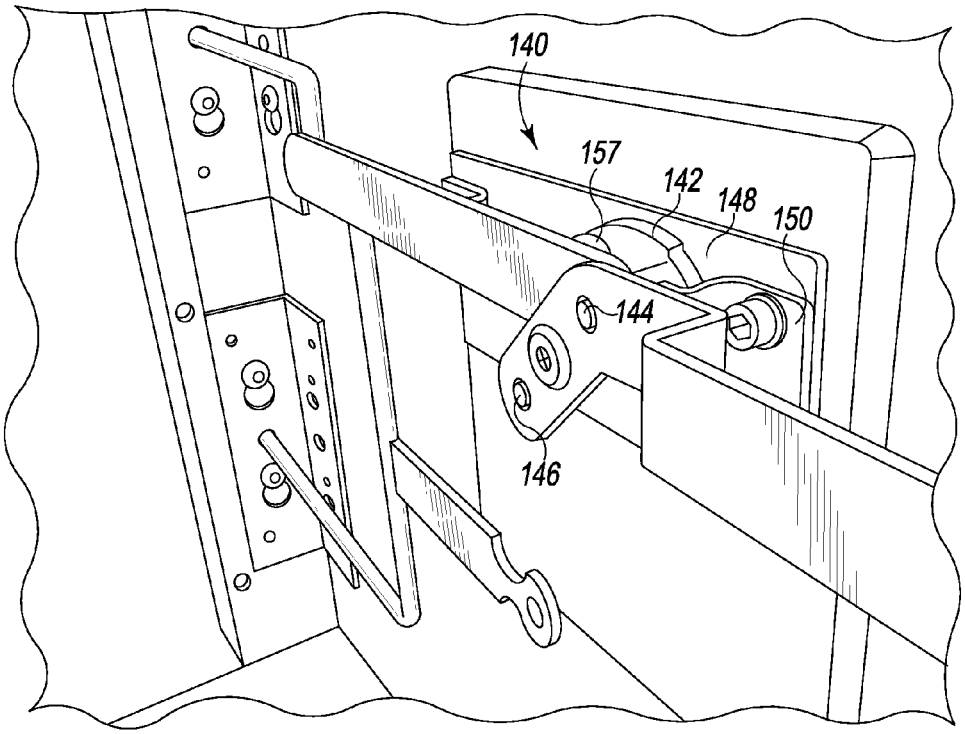
FIGS. 8-11 show the locking mechanism in the unlocked position.
Figure 9:
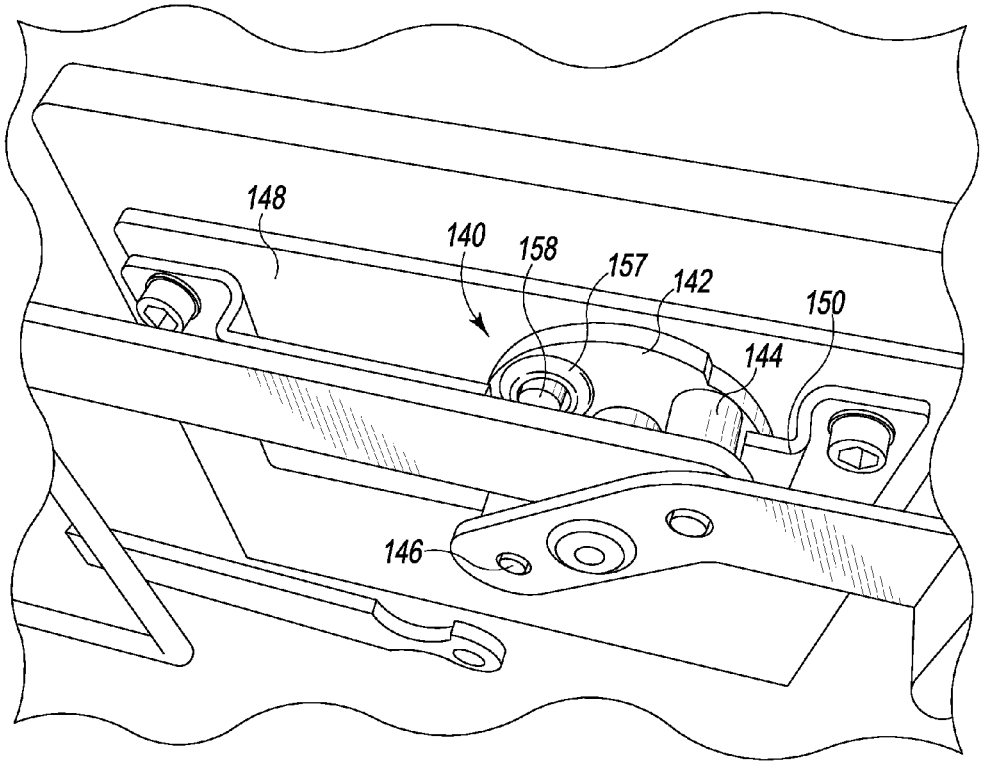
Figure 10:
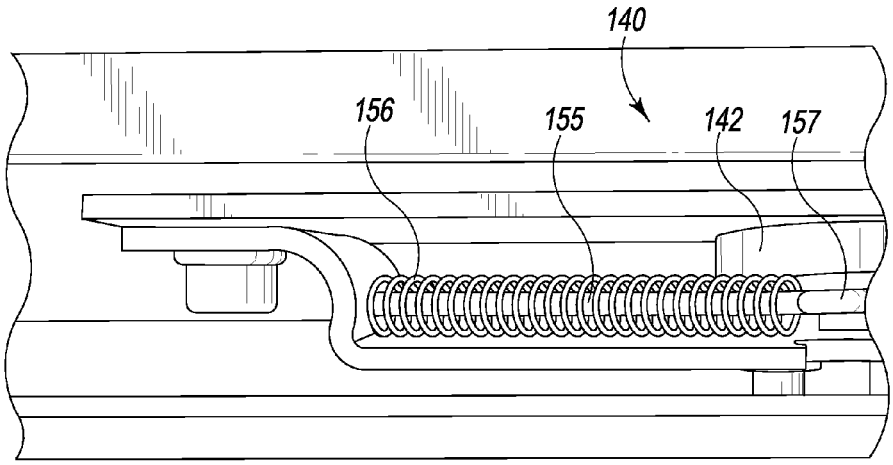
Figure 11:
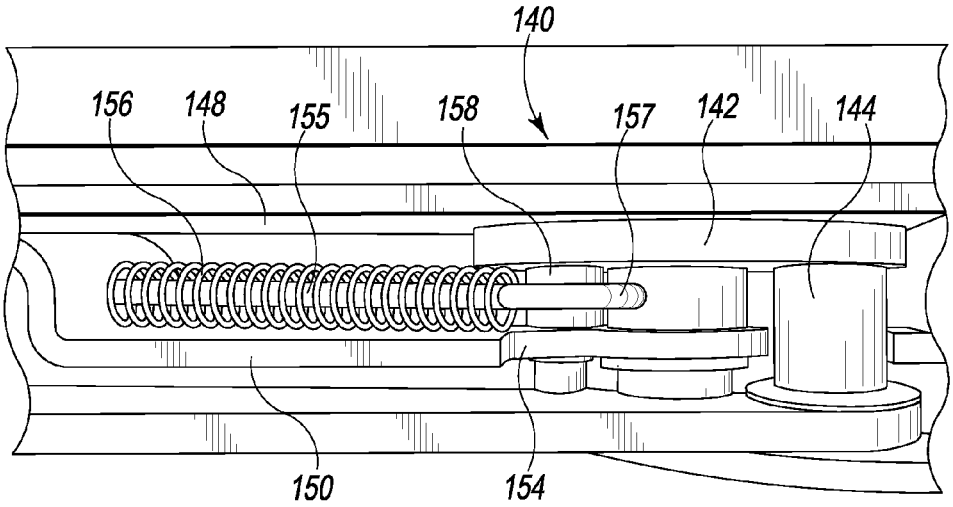
Figure 12:
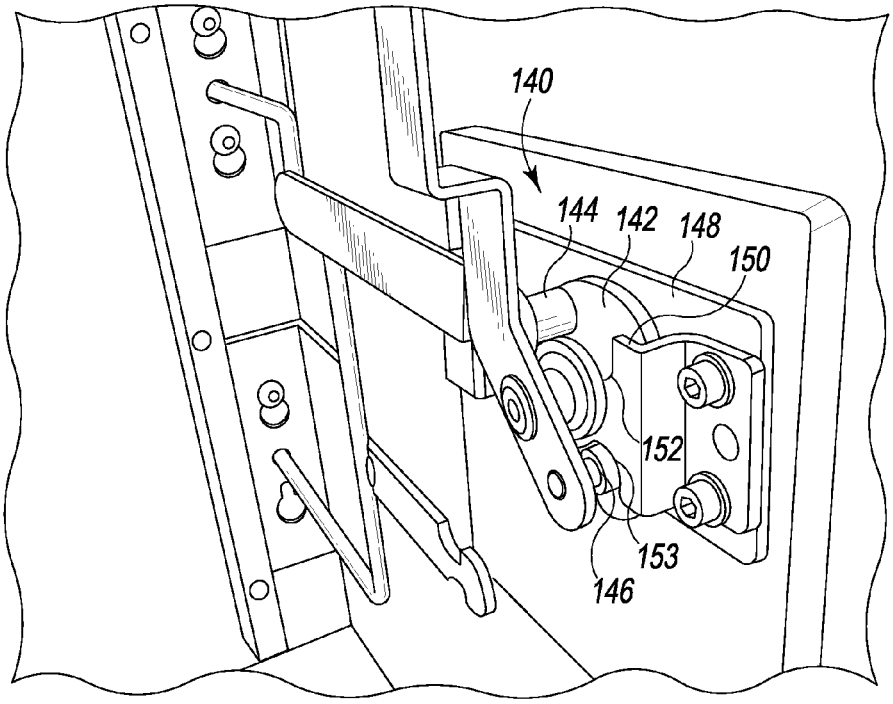
FIGS. 12-14 show the locking mechanism in the locked position.
Figure 17:
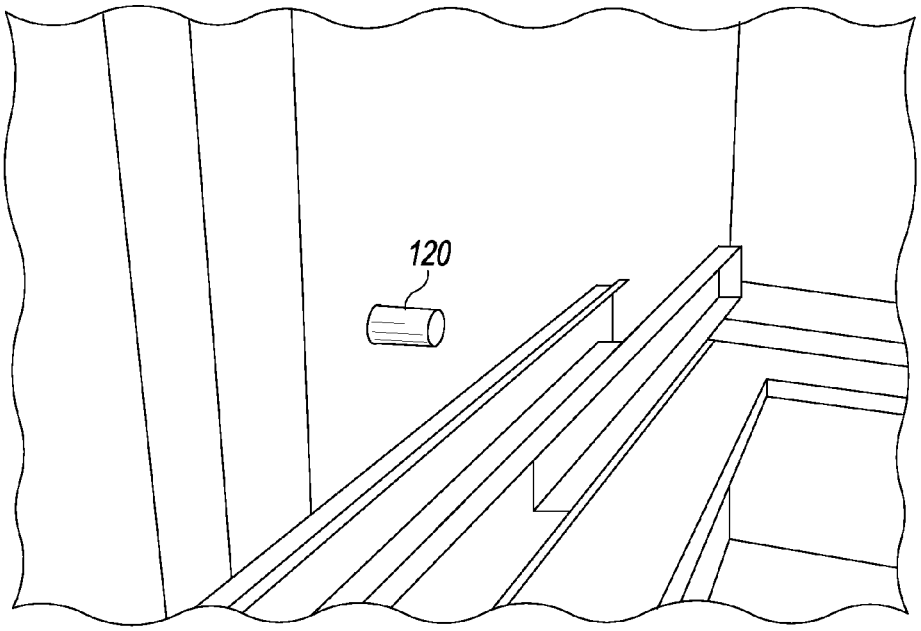
FIGS. 17 and 18 illustrate the free end of a locking rod in its locked and unlocked positions, respectively.

FIGS. 5 and 6 are rear views of the locking mechanism from within the storage compartment that is covered by bed lid 110, showing the unlocked and locked positions, respectively. The locking mechanism includes a central bellcrank 140 mounted on the rear of the recessed panel in which locking handle 112 is mounted, as described in further detail below. In FIG. 5, in which locking handle 112 is in the unlocked position, an associated internal locking arm 118 with a hook on its free end is oriented horizontally, and parallel locking rods 120 and 122 are retracted. FIG. 6 shows the locked position, in which locking handle 112 has been rotated 90 degrees, to the position shown in FIG. 4, and locking arm 118 has correspondingly rotated 90 degrees and the hook on its free end has engaged lid-locking tab 126, which is affixed to bed lid 110, thereby locking the lid closed. In FIG. 6, it can also be seen that locking rods 120 and 122 have translated horizontally toward drawers 114 and 116, respectively. Locking rods 120 and 122 "freely extend" from bellcrank 140 to the sidewall of the storage compartment. That is, no intermediate guides for the locking rods exist between bellcrank 140 and guides 119 and 121 attached to the storage compartment sidewall, which separates the storage compartment from the drawers. Guides 119 and 121 ensure that locking rods 120 and 122 are lined up with bores through the wall, such that locking rods 120 and 122 may extend therethrough, as illustrated in FIG. 12 and in FIG. 17, the latter showing the free end of rod 120 extending out of the opposite side (the drawer side) of the storage compartment sidewall into the upper drawer space. Rods 120 and 122 are joined, e.g., by welding, to connecting bars 130 and 132 to form a dual locking rod assembly for simultaneously locking drawers 114 and 116, as discussed further below. FIG. 7 shows the locking rod assembly alone, from the side opposite that shown in FIGS. 5 and 6, and shows both locking rods welded to connecting bar 130.

Figure 24:
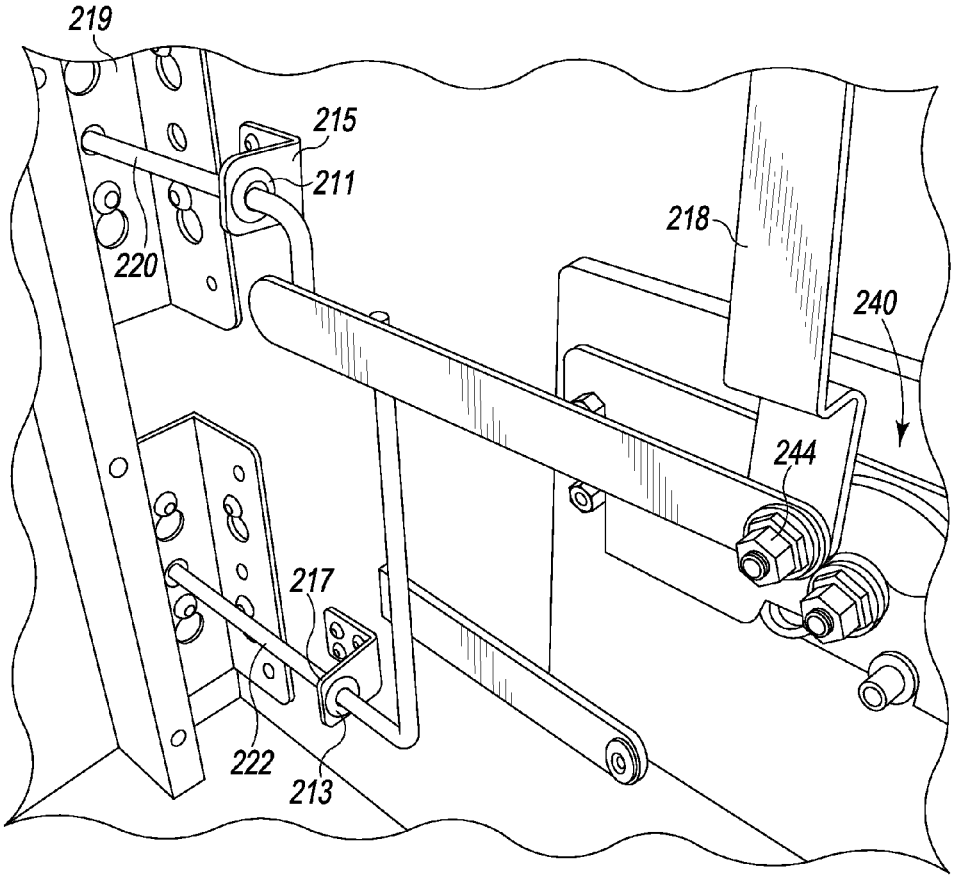
FIG. 24 illustrates an alternative locking mechanism.

In an alternative embodiment, which is less preferable, intermediate guides are provided along the path of each locking rod from the bellcrank to the sidewall guides, as shown in FIG. 24, wherein bellcrank 240 is operatively connected via a single horizontal connecting bar, as shown, to locking rods 220 and 222, which pass through intermediate guides 215 and 217 to sidewall guides 219 and 221. As can be seen, intermediate guides 215 and 217 contain grommets or O-rings 211 and 213, respectively, which slidably receive locking rods 220 and 222. While this embodiment is suitable in certain applications, it has been found that the constraint provided by intermediate guides 215 and 217 can cause binding of the locking rods extending therethrough.

Also notable in the embodiment shown in FIG. 24 is that locking arm 218 is attached to bellcrank 240 with only one pin, which is labeled 244. By contrast, in the embodiment shown in FIGS. 5 and 6, locking arm 118 is secured to bellcrank 140 with two pins, 144 and 146. The two-point attachment to the bellcrank provides a more secure attachment of the locking arm. A lift bed with the locking mechanism of FIG. 24 may otherwise be the same as the embodiment described above and may include the features in FIGS. 19-23 described below.

Figure 13:
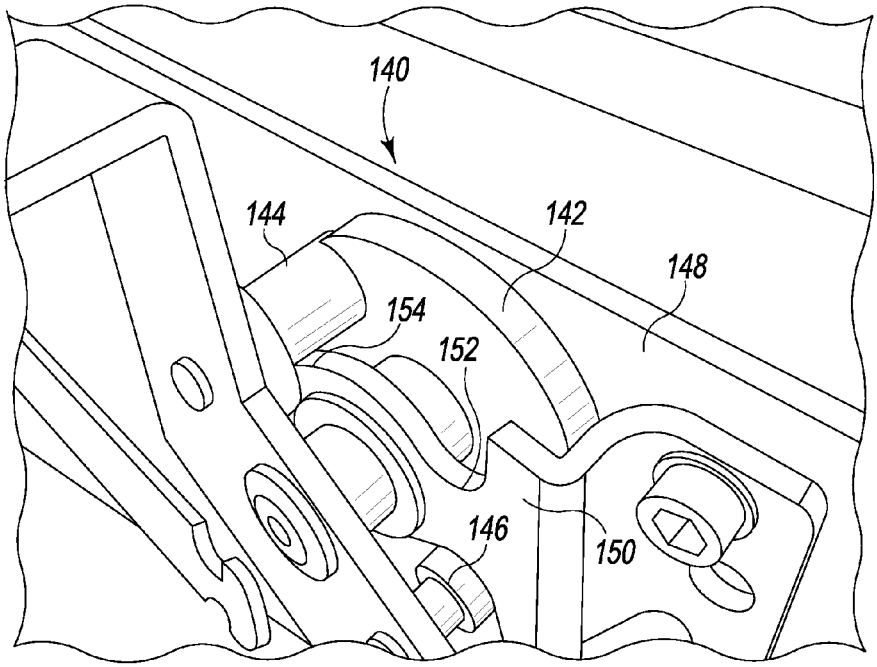
Figure 14:
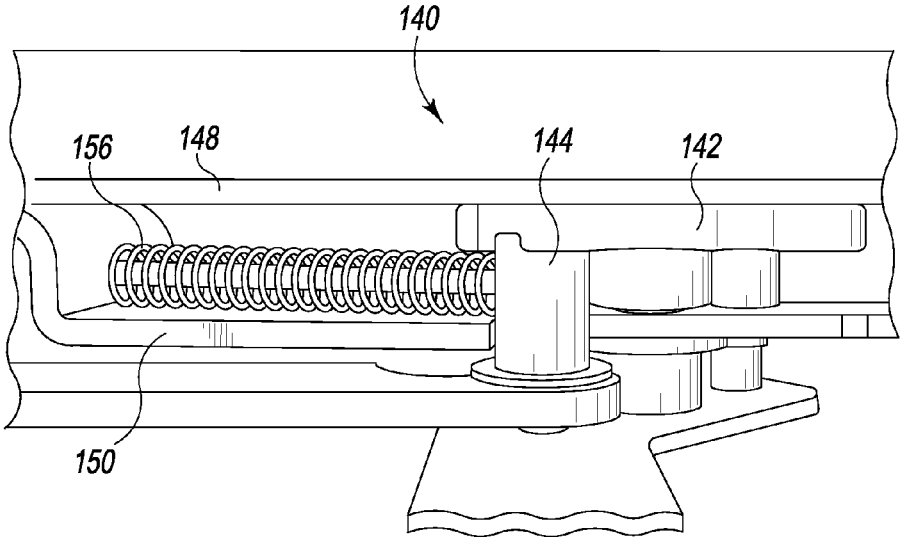

FIGS. 8-14 provide closer views of the locking mechanism described above. In FIGS. 8-11, the locking mechanism is in the unlocked position. FIGS. 12-14 show the locking mechanism in the locked position. Bellcrank 140 has a circular plate 142 with diametrically opposed pins 144 and 146 extending perpendicularly therefrom. Pin 144 connects via connecting bar 130 to locking rod 120 and also to the vertical part of locking rod 122. The bellcrank 140 is rotatably mounted between two plates 148 and 150 which are offset from each other by means of flanges on the ends of plate 150, the opposed flanges having bolt holes for attachment of plate 150 to plate 148. Plate 150 is also formed with end stops 151, 152, 153 and 154 which cooperate with pins 144 and 146 to limit the rotation of bellcrank 140 and thereby limit the horizontal travel of locking rods 120 and 122 between a fully unlocked position (FIG. 5) and a fully locked position (FIG. 6).

The bellcrank preferably has snap action which, in the illustrated embodiment, is provided by a compression spring 156 mounted within the enclosure formed by parallel plates 148 and 150 of the bellcrank. Specifically, compression spring 156 is mounted between the left end wall of the enclosure (as viewed in FIGS. 10 and 11) and an intermediate pin 158 on circular plate 142 of bellcrank 140. Intermediate pin 158 is located circumferentially midway between pins 144 and 146 described above. It is not directly connected to the compression spring; it goes through an eyelet 157 on one end of a rigid rod 155 that extends longitudinally through compression spring 156 and extends slidably through the left end wall of the enclosure. Compression spring 156 biases the bellcrank away from positions between the fully locked and fully unlocked positions, such that it tends to snap toward the locked position after the locking handle is turned more than 45° away from the unlocked position, and vice versa.

Figure 15:
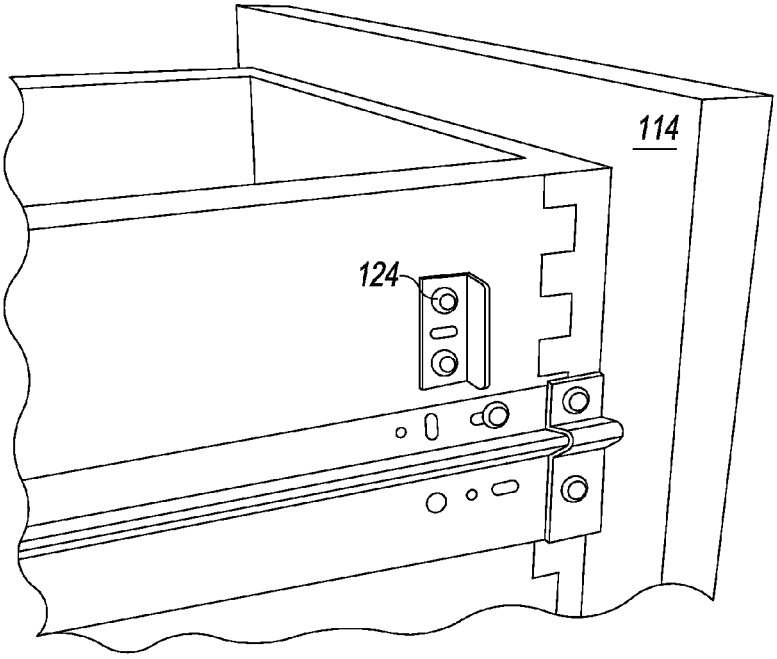
FIG. 15 is a perspective view of a locking tab on the side panel of a drawer of the bed.

FIG. 15 is a perspective view of locking tab 124 on the side panel of upper drawer 114. Lower drawer 116 includes a corresponding locking tab (not shown). Locking rod 120 slides horizontally into and out of a position that blocks outward movement of upper drawer 114. That is, when locking handle 112 is in its locked position, locking rod 120 is extended toward drawer 114 and passes through a panel in the bed frame. Its free end, shown in FIG. 17 with the drawer removed, is at the same level as locking tab 124 and closer than the locking tab to the front face of upper drawer 114, thereby preventing a person from pulling the drawer open.

Figure 18:
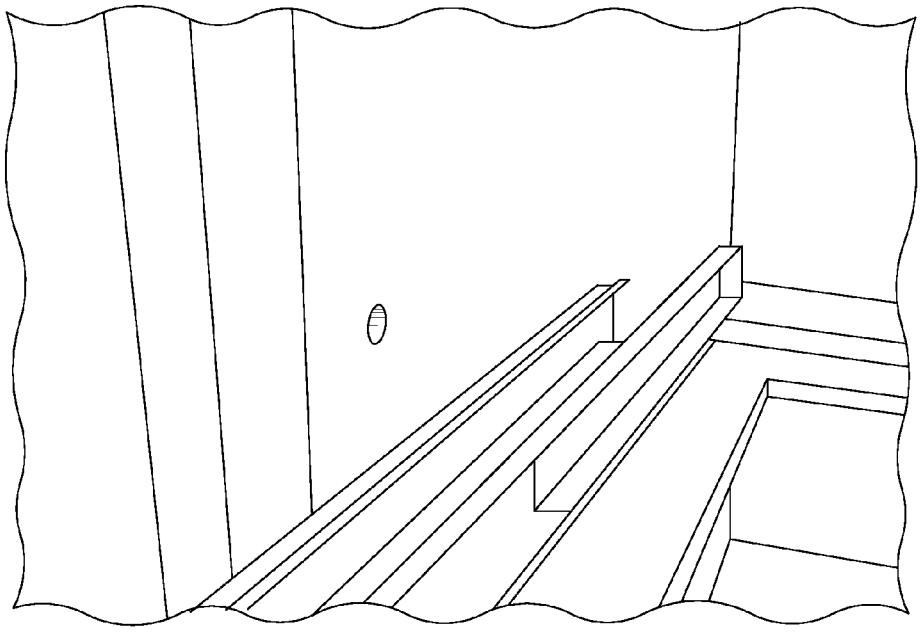

FIG. 18 is a perspective view of the same drawer space, but with locking rod 120 in its retracted position, in which the drawer is unlocked.

Figure 16:
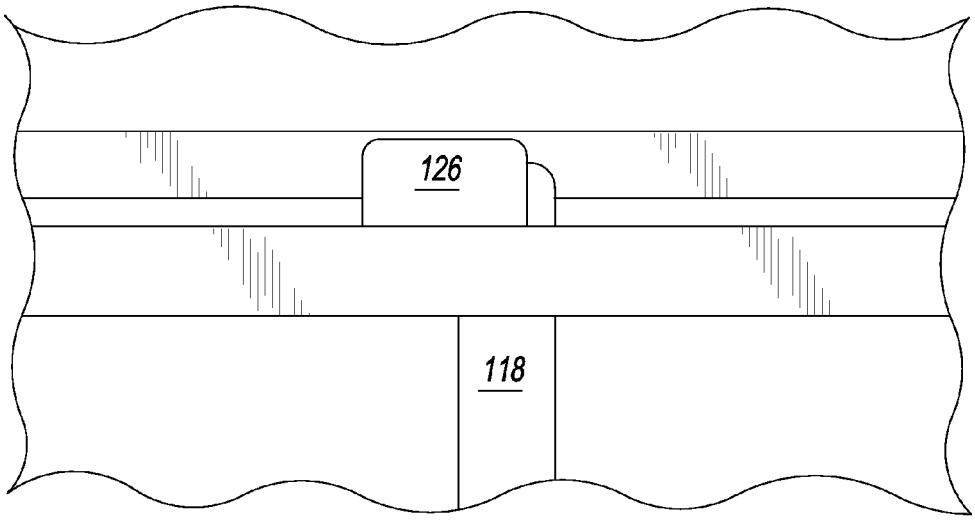
FIG. 16 shows a hook on the end of a locking arm engaged with a lid-locking tab which is affixed to the underside of the bed's lid on the side of the lid that can be raised.

FIG. 16 shows the hook on the end of locking arm 118 engaged with lid-locking tab 126, which is affixed to the underside of bed lid 110 on the side of the lid that can be raised. That is, tab 126 is located on the side of the bed lid opposite the side that is hingedly attached to the bed frame. The end of the hook on the locking arm lies over tab 126 in the engaged position shown, and the locking arm thereby prevents upward movement of tab 126 and the lid to which it is affixed. The storage compartment under the lid is thus locked.

The dual locking rod assembly is designed for use with left-side drawers or right-side drawers spaced the same distance from the bellcrank mounting panel shown in FIGS. 1 and 2. For use with left-side drawers, the orientation of the locking rod assembly is reversed by rotating the assembly 180 degrees in a vertical plane passing through both rods, such that rod 122 is the upper rod and rod 120 is the lower rod, both extending to the right rather than the left as viewed from the perspective of FIGS. 5 and 6. The bellcrank drives the rod pair through connecting bar 132 rather than through connecting bar 130. That is, connecting bar 132 is connected to pin 146 of the bellcrank instead of hanging freely (unused) as it does in FIGS. 5 and 6, and connecting bar 130 is unused. Connecting bar 130 is longer than connecting bar 132 because the bellcrank axis is horizontally off center in the bellcrank mounting panel, and thus closer to the left-side drawers. The difference in length between connecting bars 130 and 132 compensates for the off-center location of the bellcrank.

Those skilled in the art will appreciate that a bed frame in accordance with the present invention may include drawers on the left and right sides of the locking handle, with one locking rod assembly attached to the upper pin 144 of the bellcrank and extending toward a first set of drawers, e.g., right-side drawers, and another locking rod assembly attached to the lower pin 146 of the bellcrank and extending in the opposite direction toward a second set of drawers. It will also be understood by a person skilled in the art that, in an alternative embodiment, the components of the locking mechanism may be reversed, such that the locking handle is rotated counter-clockwise to lock and clockwise to unlock. For example, in such a case, the locking rod assembly for the left-side drawer(s) may be attached to the upper pin 144 of the bellcrank, and the locking rod assembly for the right-side drawer(s) may be attached to the lower pin 146.

Figure 21:
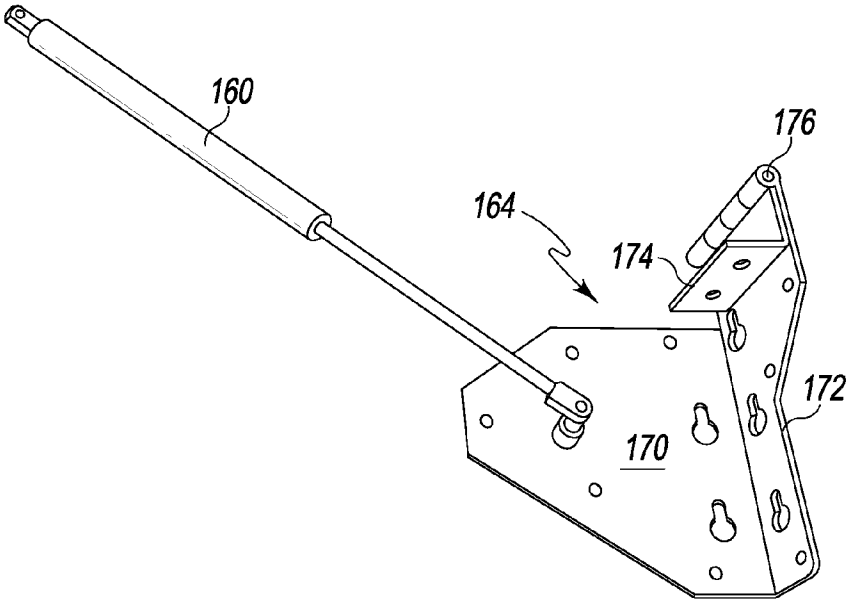
FIGS. 20 and 21 are perspective views of the left side multifunction corner bracket.
Figure 20:
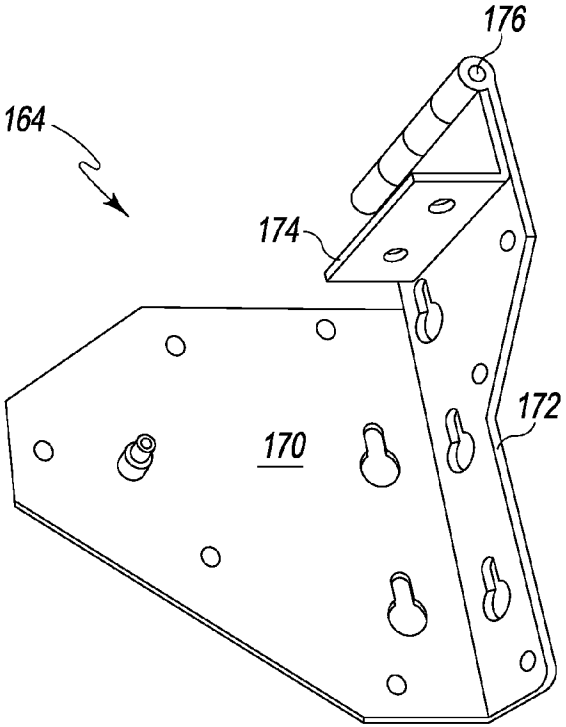

FIGS. 19-23 pertain to another embodiment of the invention, a lift bed having multifunction corner brackets 164 and 166 which each (1) serve to join perpendicular walls of the bed frame together, (2) act as a hinge for the platform, and (3) act as a mounting point for a gas spring. FIG. 19 is an upper perspective view which shows the bed of FIGS. 1 and 2 with the bed lid 110 in the open position. Left gas spring 160 and right gas spring 162 allow for controlled raising and lowering of the lid and hold the lid open when it is raised. FIGS. 20 and 21 are perspective views of left bracket 164. The multifunction bracket includes a first plate 170 and a second plate 172, perpendicular to each other and forming an L shape. The two plates 170 and 172 have holes therethrough allowing the bracket to join two perpendicularly oriented wall panels to the corresponding plates with screws, bolts or other fastening means. At the top of second plate 172 is a hinge 176 with a third metal plate 174 having holes for bolts, screws or similar fastening means for attaching the underside of the bed lid 110 to plate 174. Gas spring 160 is pivotally mounted via a mounting member, e.g., a post, on plate 170 as shown in FIGS. 20 and 21.

Figure 23:
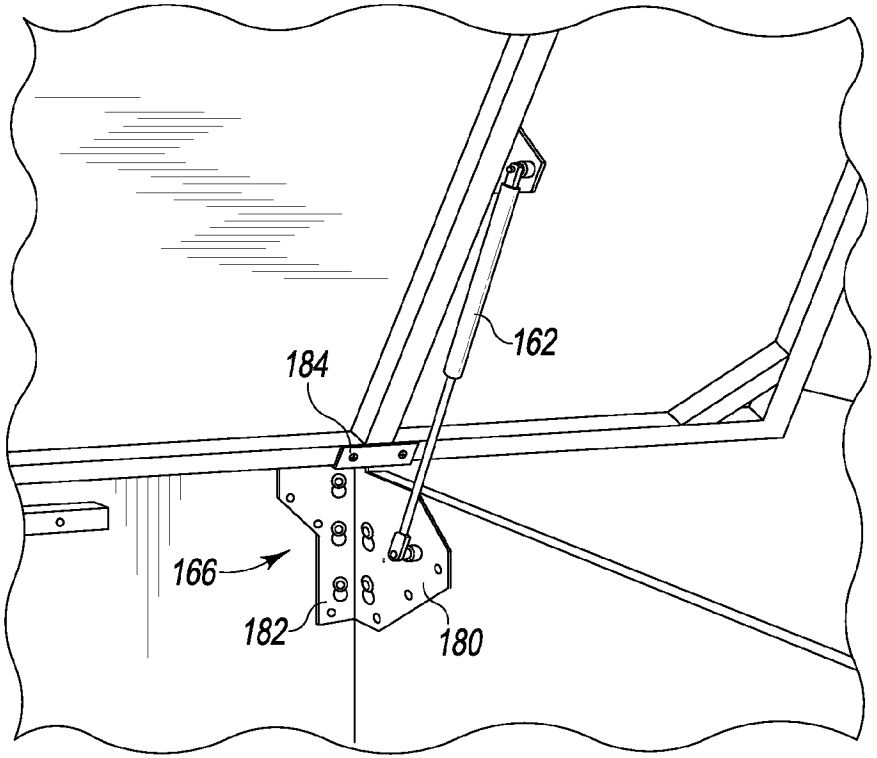
FIGS. 22 and 23 show the installed left and right multifunction brackets, respectively, in more detail.
Figure 22:
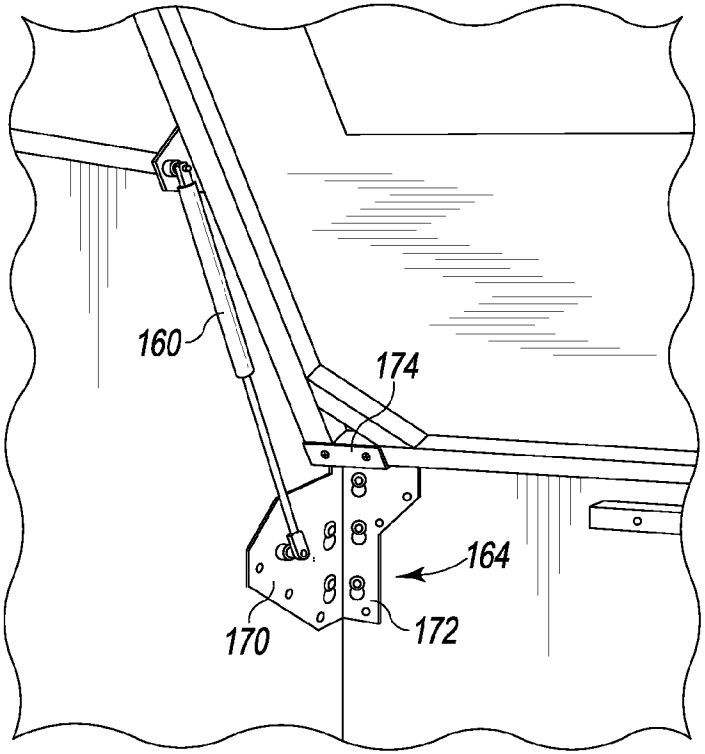

FIGS. 22 and 23 show the installed left and right multifunction brackets 164 and 166, respectively, in more detail. As shown in FIG. 22, left bracket 164 interconnects two perpendicular panels of the bed frame in the left corner, secures one end of gas spring 160, and hingedly supports bed lid 110 on the bed frame. The two brackets have "mirror-image" configurations. Accordingly, right bracket 166 includes perpendicular first and second metal plates 180 and 182, and a third metal plate 184 hingedly attached to the top of plate 182. As can be seen, right bracket 166 interconnects two perpendicular panels of the bed frame, secures one end of gas spring 162, and hingedly supports the bed lid on the bed frame.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

We claim:

1. A lift bed, comprising:

a bed frame having first and second side panels and first and second end panels, each panel having an inner vertical surface, said panels together forming a rectangular compartment, and a platform hingedly attached to the top of said side panels and adapted to support a mattress over said rectangular compartment;

first and second gas springs each having one end mounted to the underside of said platform;

a first multifunction corner bracket mounted in a top corner of said rectangular compartment immediately adjacent to said platform, and configured to interconnect perpendicular wall panels of said bed frame, hingedly support said platform, and secure a second end of said first gas spring connected to said platform, said multifunction corner bracket having perpendicular first and second vertical plates directly and immediately attached to each other and being mounted on adjacent perpendicular vertical inner surfaces of said first end panel and said first side panel, respectively;

a mounting member on said first plate connected to said second end of said first gas spring; and a third plate directly and immediately vertically pivotally attached to said second plate, said third plate being mounted to the underside of said platform;

and a second multifunction corner bracket mounted in a top corner of said rectangular compartment immediately adjacent to said platform, and configured to interconnect perpendicular wall panels of said bed frame, hingedly support said platform, and secure a second end of said second gas spring connected to said platform, said multifunction corner bracket having perpendicular first and second vertical plates directly and immediately attached to each other and being mounted on adjacent perpendicular vertical inner surfaces of said second end panel and said first side panel, respectively;

a mounting member on said first plate connected to said second end of said second gas spring; and a third plate directly and immediately vertically pivotally attached to said second plate, said third plate being mounted to the underside of said platform.

2. The lift bed of claim 1, wherein said first and second plates of each multifunction corner bracket are adjoining plates that share a one-piece, right-angle corner portion.

3. A lift bed, comprising:

a bed frame having a plurality of perpendicular walls together forming a rectangular compartment, and a platform hingedly attached to the top of said side panels and adapted to support a mattress over said rectangular compartment;

a multifunction corner bracket mounted in a top corner of said rectangular compartment immediately adjacent to said platform, and configured to interconnect perpendicular wall panels of said bed frame, and hingedly support said platform, said multifunction corner bracket having perpendicular first and second plates directly and immediately attached to each other and being mounted on adjacent walls of said bed frame, and a third plate directly and immediately vertically pivotally attached to said second plate and mounted to the underside of said platform; and a lift mechanism mounted to one of said first and second plates of said multifunction corner bracket and to said third plate.

4. The lift bed of claim 3, wherein said first and second plates are adjoining plates that share a one-piece, right-angle corner portion.

5. The lift bed of claim 3, wherein said lift mechanism is a spring.

* * * * *